US010436515B2

(12) United States Patent
Alahyari et al.

(10) Patent No.: US 10,436,515 B2
(45) Date of Patent: Oct. 8, 2019

(54) REFRIGERANT DISTRIBUTOR FOR FALLING FILM EVAPORATOR

(71) Applicant: Carrier Corporation, Farmington, CT (US)

(72) Inventors: Abbas A. Alahyari, Manchester, CT (US); Jack Leon Esformes, Jamesville, NY (US); Thomas D. Radcliff, Vernon, CT (US); Marcel Christians, Skaneateles, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 587 days.

(21) Appl. No.: 14/895,786

(22) PCT Filed: Jun. 4, 2014

(86) PCT No.: PCT/US2014/040799
§ 371 (c)(1),
(2) Date: Dec. 3, 2015

(87) PCT Pub. No.: WO2014/197538
PCT Pub. Date: Dec. 11, 2014

(65) Prior Publication Data

US 2016/0123673 A1 May 5, 2016

Related U.S. Application Data

(60) Provisional application No. 61/831,349, filed on Jun. 5, 2013.

(51) Int. Cl.
*F28D 5/02* (2006.01)
*F24F 13/30* (2006.01)
(Continued)

(52) U.S. Cl.
CPC ..... *F28D 5/02* (2013.01); *F24F 13/30* (2013.01); *F25B 39/028* (2013.01); *F28D 3/04* (2013.01);
(Continued)

(58) Field of Classification Search
CPC .. F28D 5/02; F28D 3/04; F28B 39/028; F28B 2400/13; F28B 25/005; F28F 25/04
(Continued)

(56) References Cited

U.S. PATENT DOCUMENTS 4,855,089 A * 8/1989 Michels ..... B01D 3/008 261/97
5,645,124 A 7/1997 Hartfield et al.
(Continued)

FOREIGN PATENT DOCUMENTS

CA 2843689 A1 3/2013
DE 1161922 A 1/1964
(Continued)

OTHER PUBLICATIONS

Shimamura, Masayuki, Sprinkler of Absorption Water Cooler/Heater, Jun. 30, 2000, European Patent Office, English Translation.*
(Continued)

*Primary Examiner* — Frantz F Jules
*Assistant Examiner* — Steve S Tanenbaum
(74) *Attorney, Agent, or Firm* — Cantor Colburn LLP

(57) ABSTRACT

A falling film evaporator includes a plurality of evaporator tubes through which a volume of thermal energy transfer medium is flowed, and a distributor to distribute a flow of liquid refrigerant over the plurality of evaporator tubes. The distributor includes a distributor box and a distribution sheet positioned at a bottom surface of the distributor box having a plurality of peaks and valleys, with sidewalls extending between each peak and each valley. A plurality of ports is
(Continued)

located in the sidewalls to distribute the flow of liquid refrigerant downwardly over the plurality of evaporator tubes.

19 Claims, 9 Drawing Sheets

(51) Int. Cl.

| | |
|---|---|
| ***F28D 3/04*** | (2006.01) |
| ***F25B 39/02*** | (2006.01) |
| ***F28F 25/04*** | (2006.01) |
| *F25B 25/00* | (2006.01) |
| *F28D 7/16* | (2006.01) |

(52) U.S. Cl.
CPC ..... *F28F 25/04* (2013.01); *F25B 25/005* (2013.01); *F25B 2400/13* (2013.01); *F25B 2400/23* (2013.01); *F28D 7/16* (2013.01)

(58) Field of Classification Search
USPC ..... 62/515
See application file for complete search history.

(56) References Cited

U.S. PATENT DOCUMENTS

| | | | | | |
|---|---|---|---|---|---|
| 5,836,382 | A * | 11/1998 | Dingle | ..... | F25B 39/028 165/160 |
| 6,830,099 | B2 * | 12/2004 | Moeykens | ..... | F25B 39/028 159/13.3 |
| 8,517,354 | B1 * | 8/2013 | Binkley | ..... | B01F 3/04751 261/114.4 |

FOREIGN PATENT DOCUMENTS

| | | | | | |
|---|---|---|---|---|---|
| EP | 0797065 | A2 | 9/1997 | | |
| FR | 2978818 | A1 | 2/2013 | | |
| JP | 2000179989 | A * | 6/2000 | ..... | F28D 3/02 |
| JP | 2000179989 | A * | 6/2000 | ..... | F28D 3/02 |

OTHER PUBLICATIONS

Shimamura, Masayuki, Sprinkler of Absorption Water Cooler/Heater, Jun. 30, 2000, European Patent Office, English Translation (Year: 2000).*

Notification of Transmittal of the International Search Report and the Written Opinion of the International Searching Authority, or the Declaration: PCT/US2014/040799; dated Sep. 17, 2014; 5 pages.

* cited by examiner

REFRIGERANT DISTRIBUTOR FOR FALLING FILM EVAPORATOR

BACKGROUND

The subject matter disclosed herein relates to heating, ventilation and air conditioning (HVAC) systems. More specifically, the subject matter disclosed herein relates to falling film evaporators for HVAC systems.

In falling film evaporators, saturated two-phase refrigerant is distributed over an evaporator tube bundle both in an axial direction along a length of the tube bundle and a lateral direction over a width of the tube bundle. Poor or uneven distribution results in reduced efficiency of the evaporator, which is compensated for by utilizing larger evaporators.

Two-phase flow distribution inside evaporators is challenging. Liquid and vapor in a saturated mixture have substantially different enthalpies and tend to separate due the density difference between the two phases making even distribution difficult. A typical approach to alleviate this issue involves separating the liquid and vapor refrigerant in a separator upstream of the evaporator distributor, either internal to the evaporator or outside of the evaporator. The vapor is routed back to the compressor, while the liquid refrigerant is distributed over the tube bundle via gravity, flowing the liquid refrigerant through ports in a distribution plate located over the tube bundle. While separation of vapor and liquid refrigerant increases the uniformity of liquid refrigerant distribution over the tube bundle, for uniform distribution, the orifice area in the distribution plate must be small enough such that liquid covers the plate and a liquid seal over the ports is achieved at minimum load. Otherwise substantial maldistribution can occur. This creates an issue with contaminates plugging the small ports. Larger but fewer ports can result in poor coverage of liquid over the tubes. Additionally, the flow through the ports is controlled by the hydrostatic head over the plate and at full load the liquid height must increase substantially in order to satisfy the higher flow rate demand through the ports. This results in very large distributors and a large refrigerant volume.

BRIEF SUMMARY

In one embodiment, a heating, ventilation and air conditioning (HVAC) system includes a condenser flowing a flow of refrigerant therethrough and a falling film evaporator in flow communication with the condenser. The falling film evaporator includes a plurality of evaporator tubes through which a volume of thermal energy transfer medium is flowed, and a distributor to distribute a flow of liquid refrigerant over the plurality of evaporator tubes. The distributor includes a distributor box and a distribution sheet positioned at a bottom surface of the distributor box having a plurality of peaks and valleys, with sidewalls extending between each peak and each valley. A plurality of ports is located in the sidewalls to distribute the flow of liquid refrigerant downwardly over the plurality of evaporator tubes.

In another embodiment, a falling film evaporator includes a plurality of evaporator tubes through which a volume of thermal energy transfer medium is flowed, and a distributor to distribute a flow of liquid refrigerant over the plurality of evaporator tubes. The distributor includes a distributor box and a distribution sheet positioned at a bottom surface of the distributor box having a plurality of peaks and valleys, with sidewalls extending between each peak and each valley. A plurality of ports is located in the sidewalls to distribute the flow of liquid refrigerant downwardly over the plurality of evaporator tubes.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
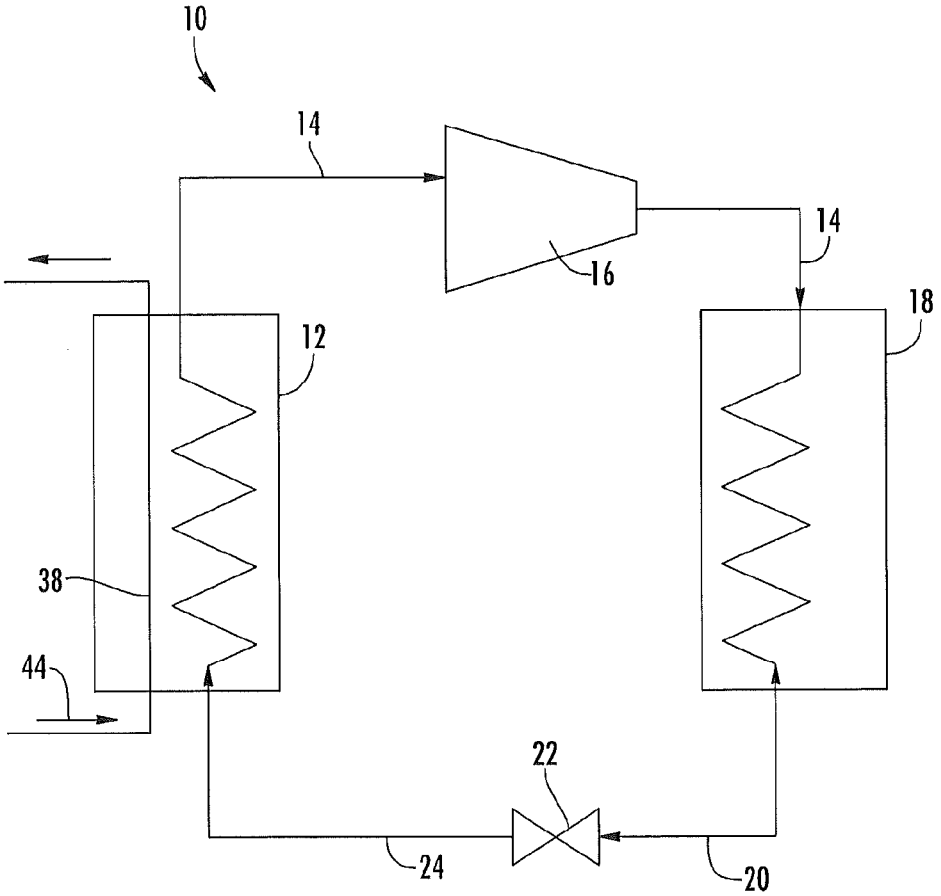
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12.

Figure 2:
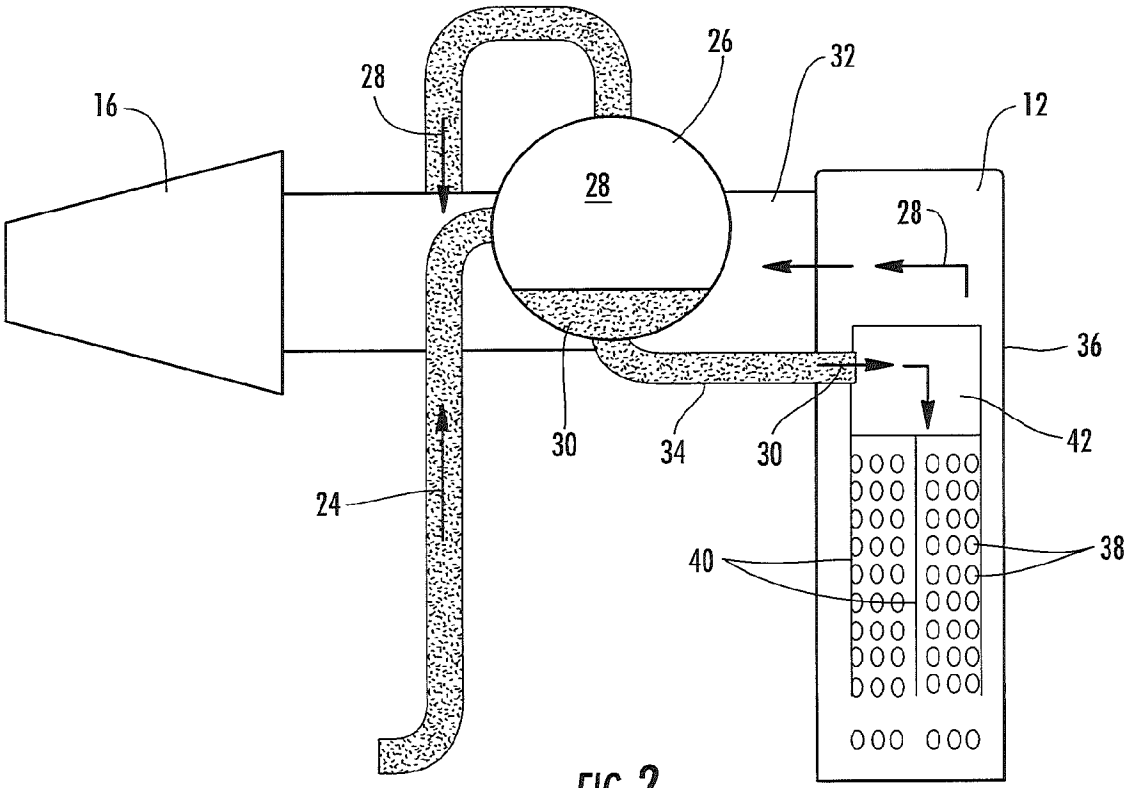
FIG. 2 is a schematic view of an embodiment of a falling film evaporator for an HVAC system.

Referring now to FIG. 2, as stated above, the evaporator 12 is a falling film evaporator. A separator 26 is located upstream of the evaporator 12 to separate the vapor refrigerant 28 and liquid refrigerant 30 components from the vapor and liquid refrigerant mixture 24. Vapor refrigerant 28 is flowed to an evaporator suction line 32 and returned to the compressor 16. Liquid refrigerant 30 is flowed via refrigerant input line 34 into the evaporator 12. Although the separator 26 is shown in this embodiment to be located outside of the evaporator 12, it is to be appreciated that in other embodiments the separator may be located within the evaporator 12. The evaporator 12 includes housing 36 with the evaporator 12 components disposed at least partially therein, including a plurality of evaporator tubes 38 grouped into tube bundles 40. A distributor 42 is located above the tube bundles 30 to distribute the liquid refrigerant 30 over the tube bundles 40. A thermal energy exchange occurs between a flow of heat transfer medium 44 flowing through the evaporator tubes 38 into and out of the evaporator 12 and the liquid refrigerant 30. As the liquid refrigerant 30 is boiled off in the evaporator 12, the resulting vapor refrigerant 28 is directed to the compressor 16 via the suction line 32.

Figure 3:
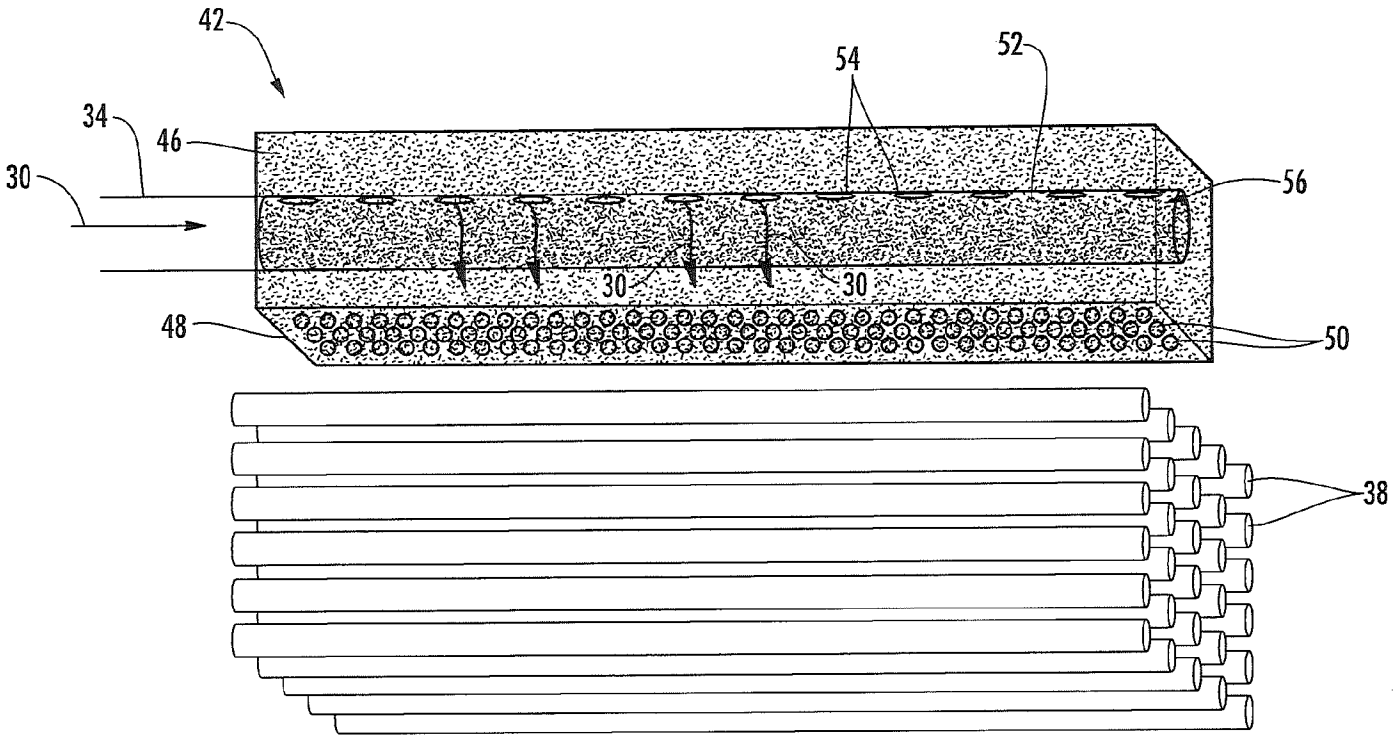
FIG. 3 is a schematic view of an embodiment of a distributor for a falling film evaporator for an HVAC system.

An embodiment of a distributor 42 is shown in FIG. 3. The distributor 42 includes a distributor box 46 having a distribution sheet 48 with a plurality of ports 50 arranged in it. In some embodiments, the distribution sheet 48 is located at a bottom surface of the distributor box 46. The liquid refrigerant 30 is flowed into the distributor box 46 via the refrigerant input line 34 and through a sparge pipe 52 with sparge openings 54 arranged on an upper portion 56 of the sparge pipe 52. The liquid refrigerant 30 flows out of the sparge openings 54 into the distributor box 46 an out through the ports 50. A typical distributor relies only on hydrostatic head to urge liquid refrigerant through the ports 50. Thus, under high loads, a typical distributor 42 having a flat distribution sheet 48 would require a large column of refrigerant in the distributor 42 to achieve the required flow rates.

Figure 4:
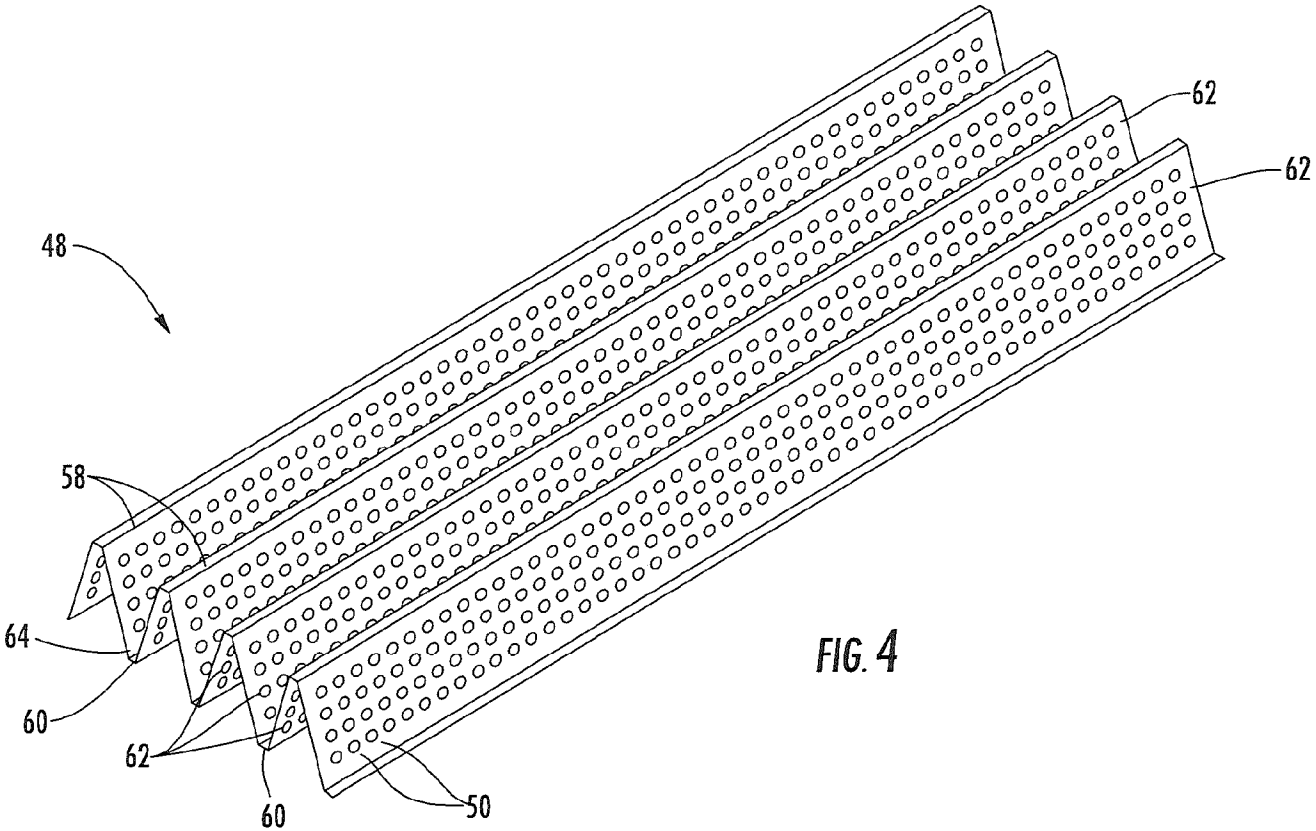
FIG. 4 is a schematic view of an embodiment of a distribution sheet for a falling film evaporator.

Referring now to FIG. 4, to increase uniformity of distribution of the liquid refrigerant 30 and reduce the refrigerant charge or size of evaporator necessary to handle high loads, the distribution sheet 48 of the distributor box 46 is corrugated, having a plurality of peaks 58 and valleys 60, with a plurality of sidewalls 62 connecting the peaks 58 and valleys 60. The ports 50 are located through the sidewalls 62 of the distribution sheet 48, with in some embodiments, several rows of ports 50, located at different heights in the sidewalls 62. During operation of the chiller 10, as load and thus liquid refrigerant 30 flow rate increases, a level of liquid refrigerant 30 in the distributor 42 also increases. Due to the locations of ports 50 on the sidewalls 62, however, available ports 50 for the flow of liquid refrigerant 30 through the distribution sheet 48 also increase. This reduces the need to build up excessive levels of liquid refrigerant 30 in the distributor 42 to achieve the necessary flow rate therethrough. Further, ports 50 located on the sidewalls 62 are less likely to collect contaminants. In some embodiments, a lowermost portion, which in the embodiment of FIG. 4 is a horizontal valley portion 64, is free of ports 50 so that contaminants in the liquid refrigerant 30 settle thereat without impeding flow through the ports 50. In some embodiments the distribution sheet 48 may be stamped into a final configuration, or a predrilled flat sheet may be bent or folded into shape, or another suitable process may be utilized.

Figure 6:
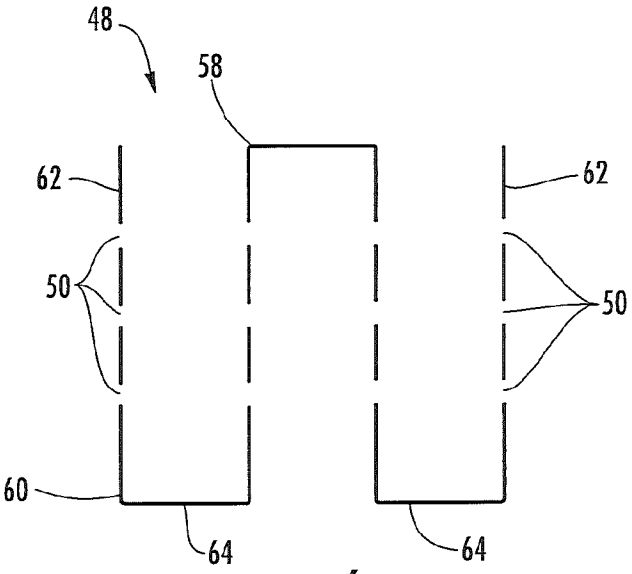
FIG. 6 is a cross-sectional view of another embodiment of a distribution sheet for a falling film evaporator.
Figure 5:
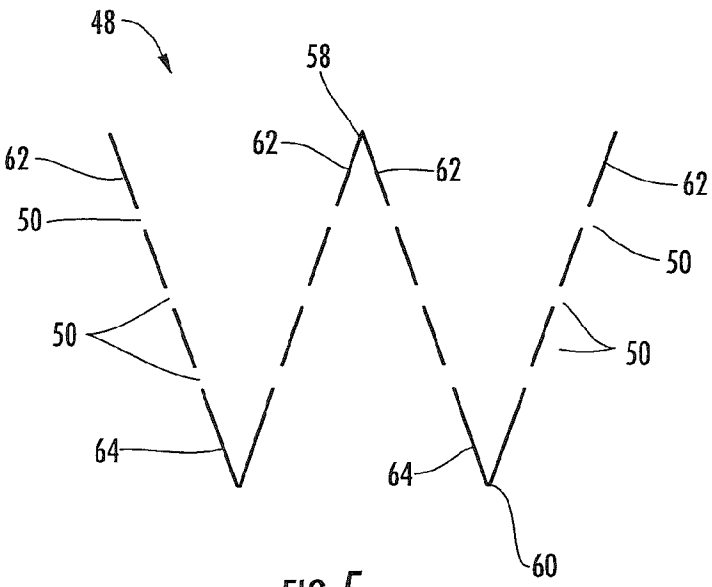
FIG. 5 is a cross-sectional view of an embodiment of a distribution sheet for a falling film evaporator.
Figure 8:
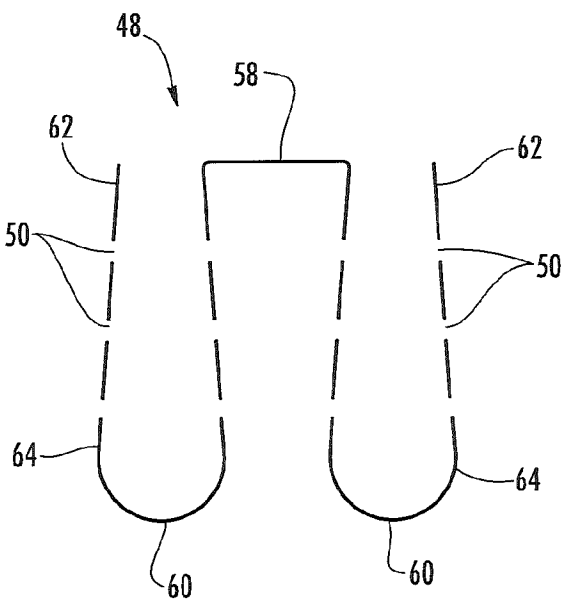
FIG. 8 is a cross-sectional view of still another embodiment of a distribution sheet for a falling film evaporator.
Figure 7:
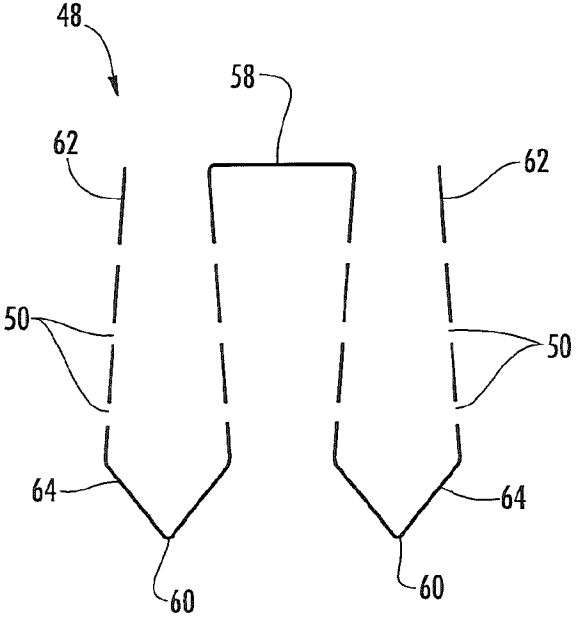
FIG. 7 is a cross-sectional view of an yet another embodiment of a distribution sheet for a falling film evaporator.

Other configurations are shown in the cross-sectional views of FIGS. 5-8. In the embodiment of FIG. 5, the sidewalls 62 are sloping and intersect at valley portion 64, where contaminants collect. In FIG. 6, the sidewalls 62 are parallel and vertical and extend to a horizontal valley portion 64. In the embodiments of FIGS. 7 and 8, the sidewalls 62 extend at a diverging angle toward the valley portion 64. The valley portion 64 may be pointed as in FIG. 7, or curvilinear as in FIG. 8. It is to be appreciated that that these embodiments are merely exemplary, and other cross-sectional shapes may be utilized.

Figure 9:
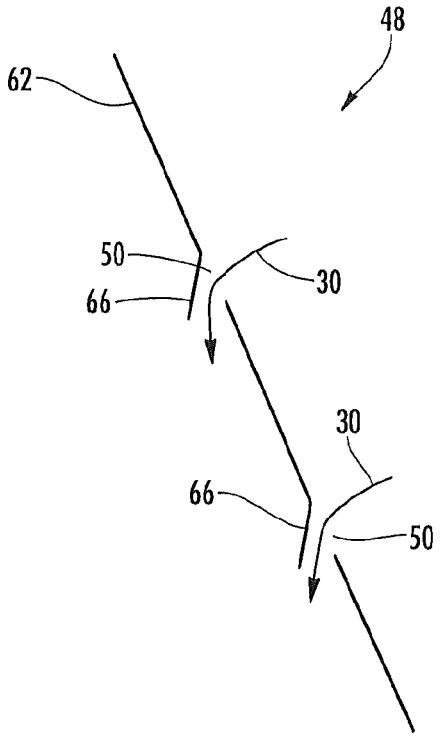
FIG. 9 is a cross-sectional view of a port for a distribution sheet for a falling film evaporator.

As shown in FIG. 9, the ports 50 may include louvers 66. Extending from the sidewalls 62. During operation, the louvers 66 act to direct the liquid refrigerant 30 in a downward direction.

Figure 10:
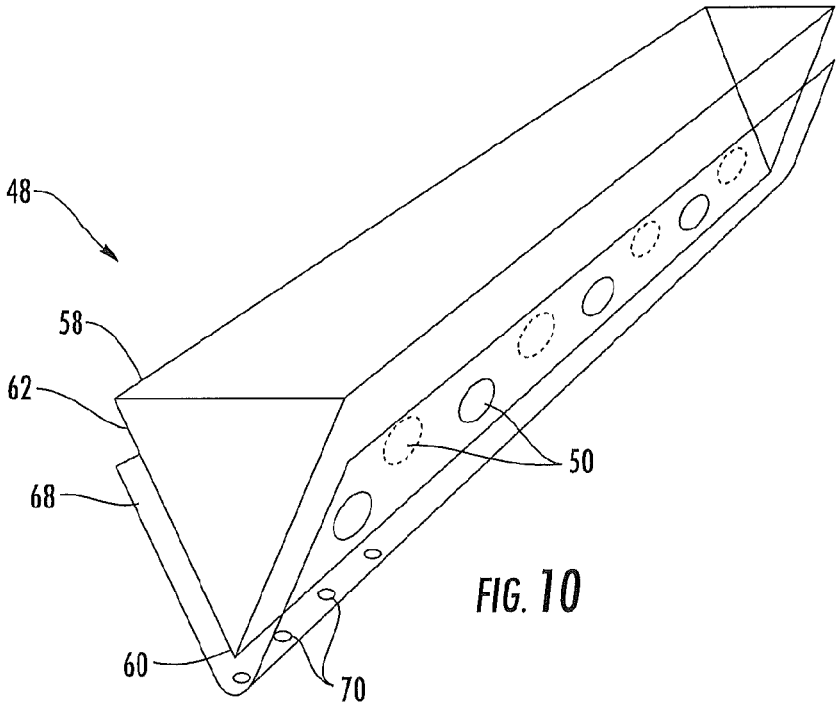
FIG. 10 is a schematic view of another embodiment of a distribution sheet for a falling film evaporator.
Figure 11:
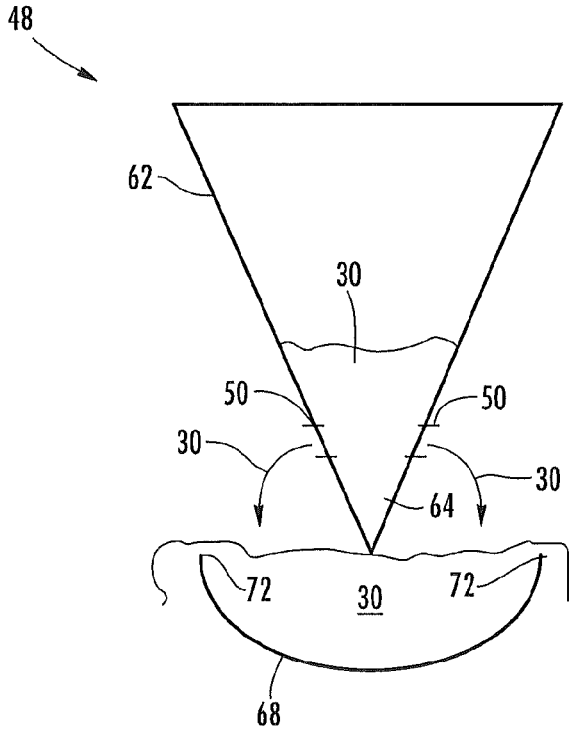
FIG. 11 is a cross-sectional view of yet another embodiment of a distribution sheet for a falling film evaporator.

Referring to FIGS. 10 and 11, a secondary distribution sheet 68 may be positioned below the distribution sheet 48, with secondary ports 70 located therein. The liquid refrigerant 30 flowing through the ports 50 collects in the secondary distribution sheet 68 then flows through the secondary ports 70 and onto the tube bundles 40. Alternatively, liquid refrigerant 30 flows over an edge 72 of the secondary distribution sheet 68 and onto the tube bundles 40. Additionally, a secondary distribution sheet 68 may be located above the distribution sheet 48. Referring again to FIG. 10, positions of the ports 50 may be staggered vertically along the length of the distribution sheet 48, and/or staggered relative to ports 50 in adjacent sidewalls 62. Further, while circular ports 50 are shown, the ports 50 may be other, noncircular shapes, for example, triangular. Additionally, the port 50 size and or spacing may vary.

The distribution sheet 48 disclosed herein improves uniformity of distribution of liquid refrigerant 30 over the tube bundles 40, resulting in improved performance over a wide range of flow conditions. It reduces refrigerant charge volume and cost and reduces system height due to reduced required liquid refrigerant 30 column height at high load conditions. Further, the arrangement of the ports 50 on the sidewalls 62 reduces contaminant plugging of the ports 50 making the system more resistant to fouling.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a condenser flowing a flow of refrigerant therethrough;

a falling film evaporator in flow communication with the condenser including:

a plurality of evaporator tubes through which a volume of thermal energy transfer medium is flowed;

a distributor to distribute a flow of liquid refrigerant over the plurality of evaporator tubes, the distributor including:

a distributor box; and a distribution sheet disposed at a bottom surface of the distributor box having a plurality of peaks and valleys, with sidewalls extending between each peak and each valley, a plurality of ports disposed in the sidewalls to distribute the flow of liquid refrigerant downwardly over the plurality of evaporator tubes;

wherein the distribution sheet includes a valley portion between adjacent sidewalls free of ports for collection of contaminants; and wherein the valley portion is horizontal, the valley portion extending longitudinally past at least two rows of the plurality of ports disposed in the sidewalls; and wherein the plurality of ports are arranged in rows extending upwardly along the sidewalls.

2. The HVAC system of claim 1, wherein the plurality of ports are arranged in rows extending upwardly along the sidewalls.

3. The HVAC system of claim 1, wherein adjacent sidewalls of the plurality of sidewalls extend at a converging angle toward the valley disposed therebetween.

4. The HVAC system of claim 1, wherein adjacent sidewalls of the plurality of sidewalls extend at a diverging angle toward the valley disposed therebetween.

5. The HVAC system of claim 1, wherein the sidewalls extend vertically from the distribution box.

6. The HVAC system of claim 1, wherein the plurality of ports include one or more louvers extending therefrom.

7. The HVAC system of claim 1, wherein the plurality of ports are staggered vertically along a length of the distribution sheet.

8. The HVAC system of claim 1, wherein the plurality of ports are noncircular.

9. The HVAC system of claim 1, further comprising a secondary distribution sheet disposed below the distribution sheet.

10. The HVAC system of claim 9, wherein the secondary distribution sheet includes a plurality of secondary ports.

11. The HVAC system of claim 1, further comprising a separator to separate liquid and vapor refrigerant from a two phase refrigerant mixture and allowing flow of the liquid refrigerant to the falling film evaporator.

12. A falling film evaporator comprising:

a plurality of evaporator tubes through which a volume of thermal energy transfer medium is flowed;

a distributor to distribute a flow of liquid refrigerant over the plurality of evaporator tubes, the distributor including:

a distributor box; and a distribution sheet disposed at a bottom surface of the distributor box having a plurality of peaks and valleys, with sidewalls extending between each peak and each valley, a plurality of ports disposed in the sidewalls to distribute the flow of liquid refrigerant downwardly over the plurality of evaporator tubes;

wherein the distribution sheet includes a valley portion between adjacent sidewalls free of ports for collection of contaminants;

wherein the valley portion is horizontal, the valley portion extending longitudinally past at least two rows of the plurality of ports disposed in the sidewalls; and wherein the plurality of ports are arranged in rows extending upwardly along the sidewalls.

13. The falling film evaporator of claim 12, wherein adjacent sidewalls of the plurality of sidewalls extend at a converging angle toward the valley disposed therebetween.

14. The falling film evaporator of claim 12, wherein adjacent sidewalls of the plurality of sidewalls extend at a diverging angle toward the valley disposed therebetween.

15. The falling film evaporator of claim 12, wherein the sidewalls extend vertically from the valley portion.

16. The falling film evaporator of claim 12, wherein the plurality of ports include one or more louvers extending therefrom.

17. The falling film evaporator of claim 12, further comprising a secondary distribution sheet disposed below the distribution sheet.

18. The falling film evaporator of claim 17, wherein the secondary distribution sheet includes a plurality of secondary ports.

19. The falling film evaporator of claim 12, wherein:

the plurality of peaks are disposed vertically above the plurality of ports; and the valley portion is disposed vertically below the plurality of ports.

* * * * *